US012778302B2

(12) United States Patent
Fatkullin

(10) Patent No.: US 12,778,302 B2
(45) Date of Patent: Nov. 3, 2026

(54) CHAIR

(71) Applicant: Amir Fatkullin, Ufa (RU)

(72) Inventor: Amir Fatkullin, Ufa (RU)

( * ) Notice: Subject to any disclaimer, the term of this patent is extended or adjusted under 35 U.S.C. 154(b) by 0 days.

(21) Appl. No.: 18/723,399

(22) PCT Filed: Apr. 20, 2023

(86) PCT No.: PCT/RU2023/050097

§ 371 (c)(1),
(2) Date: Jun. 21, 2024

(87) PCT Pub. No.: WO2024/014990

PCT Pub. Date: Jan. 18, 2024

(65) Prior Publication Data

US 2025/0221534 A1 Jul. 10, 2025

(30) Foreign Application Priority Data

Jul. 25, 2022 (RU) ..... RU2022120313

(51) Int. Cl.
*A47C 3/026* (2006.01)
*A47C 1/032* (2006.01)
*A47C 3/025* (2006.01)

(52) U.S. Cl.
CPC ..... *A47C 3/026* (2013.01); *A47C 1/03283* (2013.01); *A47C 3/0255* (2013.01)

(58) Field of Classification Search
CPC ..... A47C 3/026; A47C 7/446; A47C 1/0246; A47C 1/03283; A47C 3/0255; A47C 1/03255
See application file for complete search history.

(56) References Cited

U.S. PATENT DOCUMENTS

| | | | | |
|---|---|---|---|---|
| 2008/0067848 | A1* | 3/2008 | Brauning | A47C 1/03266 297/323 |
| 2014/0103688 | A1* | 4/2014 | Wilson | A47C 7/46 297/284.7 |
| 2015/0201758 | A1* | 7/2015 | Serber | A47C 1/024 297/300.2 |
| 2017/0027328 | A1* | 2/2017 | Su | A47C 7/40 |
| 2017/0354254 | A1* | 12/2017 | Diffrient | A47C 7/448 |
| 2022/0354254 | A1* | 11/2022 | Collier | A47C 7/443 |

* cited by examiner

*Primary Examiner* — Alfred J Wujciak

(74) *Attorney, Agent, or Firm* — Patentagar PLLC; Alexander Rabinovich

(57) ABSTRACT

An office chair comprises a seat, a seatback, and a chair base with a central support on which a rocking mechanism comprising a supporting base is installed. A seatback frame comprises a transverse curved plate to which a preferably elastic vertical plate is attached by means of a pivotal connection in such a way that an axis of the pivotal connection is at about the middle of the seatback height. On its other end, the vertical plate is connected to a seatback base which in turn is connected to the supporting base. The seat is fixed to the rocking mechanism. Placed between the transverse plate and the upper part of the seatback is a gas-lift unit. Positioned on the vertical plate is an element for adjusting the initial position of the seatback. The chair can turn its seatback providing comfort for the user while taking various sitting positions.

1 Claim, 2 Drawing Sheets

CHAIR

Figure 1:
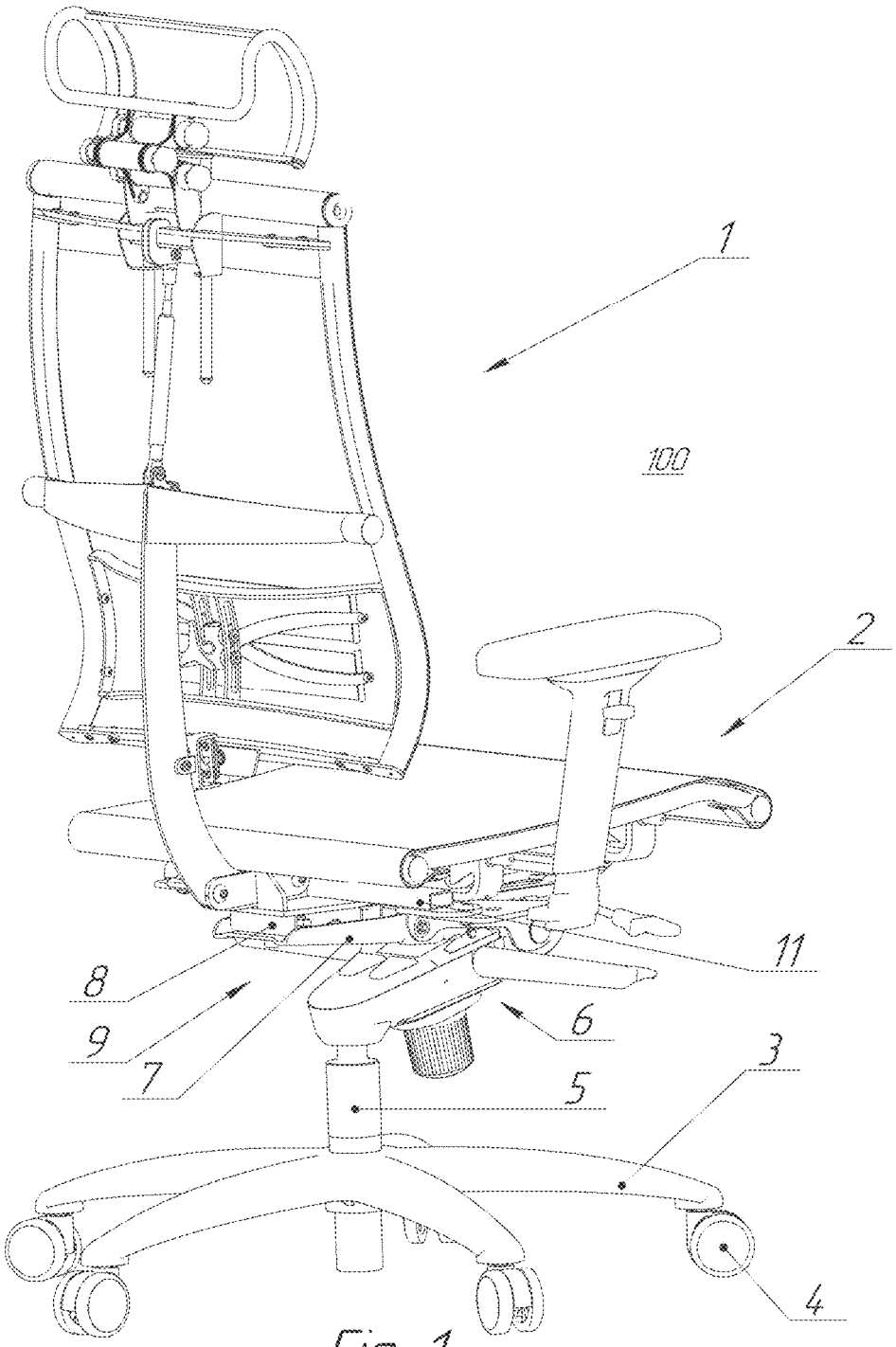

The invention relates to furniture and more particularly to an office chair having the ability to turning and reclining the back that helps to choose a comfortable position of the user.

A well-known chair with rocking back (RU 2437605, IPC A47C1/032, published 27 Dec. 2011) contains a supporting structure, a seat, a seatback with a support and a resilience part.

The chair is joined with the supporting structure by means of a connection of an articulated parallelogram type that includes a first arm and a second arm to allow movement of the seat between the lowered position and the raised position.

The seatback is installed so that it can move between a vertical position and the position reclined backwards. The moving of the seatback to the reclined position causes the seat to move to the raised position, and vice versa.

The resilience part tends to return the seat to the lowered position and the seatback to the vertical position.

The seat is suspended on a sliding support installed in such a way that reclining the seatback support backwards causes the sliding support, on which the seat is mounted, to be lowered in relation to the seat support.

The disadvantage of the known design is that the limited ability to rotate the seatback does not provide sufficient flexibility in taking various sitting positions.

A well-known office chair (EP 2787860, IPC A47C1/032, published 10 Jan. 2018) has a seatback, a seat connected to the seatback, a connection assembly unit connected to the seatback and the seat and designed to elastically restrain the pivot motion of the seatback.

The connection assembly unit ensures that the seat surface rotates in a given relation to the pivot motion of the seatback, so that the seatback and the seat surface open to each other at an opening angle when the seatback rotates.

This office chair also does not provide sufficient flexibility in taking various sitting positions.

Also known (U.S. Pat. No. 8,297,701 B2, IPC A47C1/32, published 19 Oct. 2010) has been an adjustable chair including a seat adapted to support a user, a seatback, a base, and a control system mounted on the base.

The control system connects the seatback and the seat and includes a mechanism for adjusting the resistance to reclining applied by the user to the seatback to move it backwards from the vertical position.

The resistance adjustment mechanism includes a resilience part under load, while the chair is reclining, to provide resistance to the reclining force.

The disadvantage of this chair is the complexity of the control system arrangement changing the resistance of the seatback reclining force. In addition, the chair does not provide sufficient comfort for the user's back.

The object of the invention is to develop a reliable and easy-to-use chair.

The technical result is the providing of the additional flexibility with respect to taking various sitting positions.

The issue can be solved, and the technical result can be achieved by providing a chair comprising a seatback, a seat, and a base with a central stand. A rocking mechanism is installed on the stand. The mechanism comprises a supporting base with a supporting plate mounted to it and on which a metal elastic vertical plate is fixed connected with the seatback of the chair through a curved horizontal plate fixed to the middle part of the chair seatback.

According to the invention, the curved horizontal plate can be attached to the vertical plate by means of a bolted joint.

According to the invention, the curved horizontal plate can be attached to the seatback of the chair by means of a hinged joint.

According to the invention, the supporting plate can be attached to the supporting base of the rocking mechanism by means of a bolted joint.

Figure 2A:
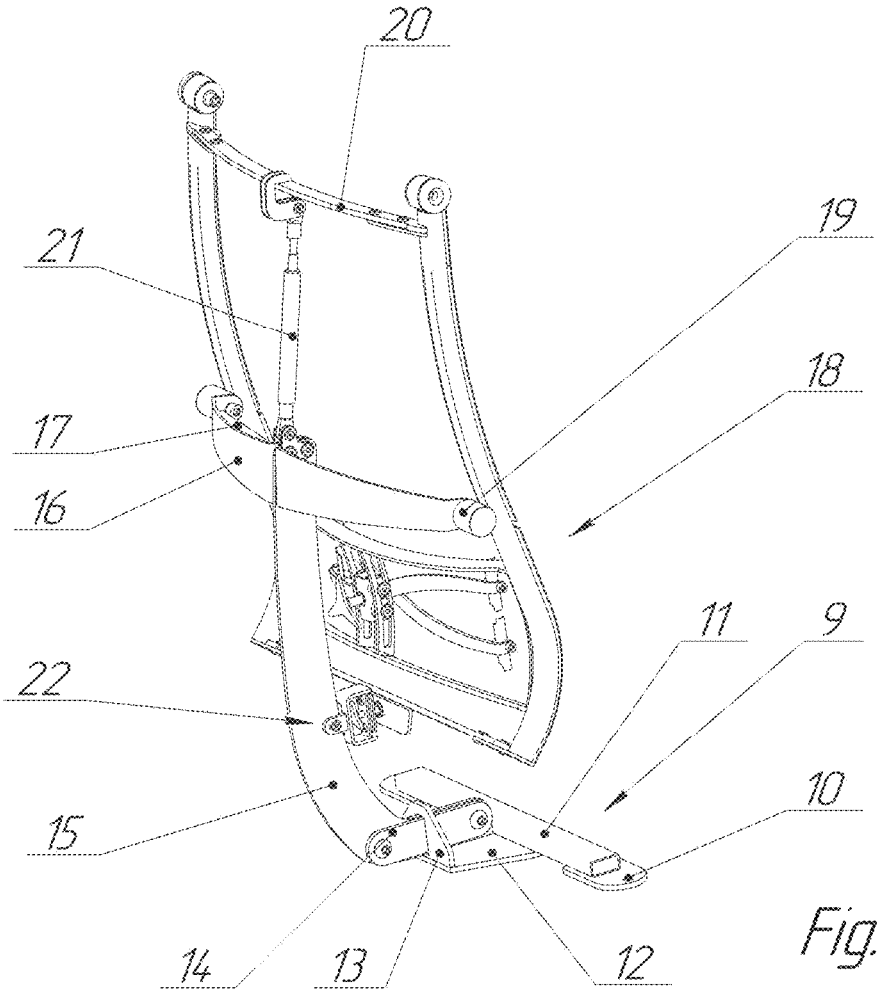
Figure 2B:
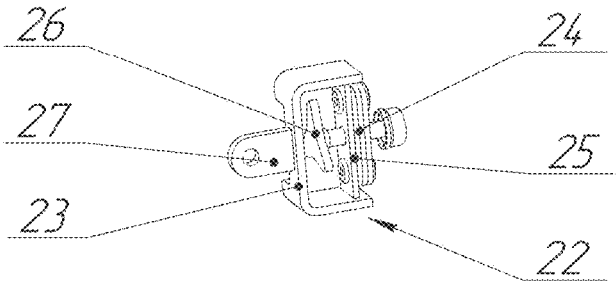

The essence of the invention is explained by drawings of a particular example of implementation of the chair, where FIG. 1 illustrates a general view of the chair, FIG. 2*a* illustrates fragments of the connection assemblies, and FIG. 2*b* presents one of the elements of the chair in more detail.

The chair 100 comprises a seatback (1), a seat (2), and a five-prong base (3) with rollers (4). The base has a central support (5) on which a rocking mechanism (6) with a supporting base (7) is arranged. The seat (2) is fixed to the rocking mechanism (6). A supporting box (8) is mounted on the supporting base (7) by means, for example, a bolted joint (not shown).

A seatback base (9), that comprises two first plates (10), a mould tube (11), second, third and fourth plates (12, 13 and 14, respectively) fixed to each other by welding, is installed on the supporting box (8) and fixed with screws (not shown) to the supporting base (7).

A vertical plate (15) is connected to the fourth plate (14) by means of the screwed connection. Due to the flexible properties of the vertical plate (15) resilient resistance to the pivot motion of the seatback (1) is provided, and the manufacture of the vertical plate (15) of metal increases the reliability and durability of the construction.

The vertical plate (15) is connected to an intermediate transverse plate (16) by means of a bolted joint. Fifth plates (17) are welded to the intermediate plate (16) in order to ensure the rigidity of the latter. The vertical plate 15 is centrally located relative to a seatback frame (18).

The seatback frame (18) is connected to the curved plate (16) by means of a pivotal connection (19). This arrangement of the pivotal connection ensures the redistribution of load on various muscle groups of the back when the user rests on the seatback.

A gas strut (21) is installed between the intermediate transverse plate (16) and an upper transverse plate (20) of the seatback frame (18); the gas strut (21) provides a smooth rotation of the seatback around the axis of the pivotal connection (19). Attached to the vertical plate (15) is an element (22) of stop and adjustment of the initial position of the seatback, the element (22) comprising a second box (23) with a bent piece (27) immediately affixed to the vertical plate (15), mediation plates (24) and (25), and a screw (24).

In view of this, the claimed invention suggests a reliable, comfortable chair design that provides a comfortable position of the user's back and good flexibility when taking various sitting positions.

The invention claimed is:

1. A chair comprising a seatback, a seat, a rocking mechanism, and a chair base, the seatback comprising a frame and a seatback base, the chair base comprising a central support, the rocking mechanism comprising a supporting base and being arranged on the central support, the seat being affixed to the rocking mechanism, the seatback being connected to the rocking mechanism through the seatback frame comprising an intermediate transverse plate to which a vertical plate is fastened with one end thereof, the vertical plate being fastened to the seatback base with an opposite end thereof, the vertical plate being located centrally relative to the frame, and the seatback base being connected to the supporting base of the rocking mechanism, wherein the seatback base comprises mutually perpendicular plates and shaped tubes welded to each other.

* * * * *